US011912448B2

(12) United States Patent
Anzaldi et al.

(10) Patent No.: US 11,912,448 B2
(45) Date of Patent: Feb. 27, 2024

(54) METHOD AND A PACKAGING APPARATUS FOR FORMING SEALED PARTIALLY-FILLED PACKAGES

(71) Applicant: TETRA LAVAL HOLDINGS & FINANCE S.A., Pully (CH)

(72) Inventors: Daniele Anzaldi, Eindhoven (NL); Nicola Garuti, Scandiano (IT); Yutaka Kaneko, Tokyo (JP); David Arturo Fuga Martin, Bologna (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 243 days.

(21) Appl. No.: 17/296,911

(22) PCT Filed: Nov. 7, 2019

(86) PCT No.: PCT/EP2019/080531
§ 371 (c)(1),
(2) Date: May 25, 2021

(87) PCT Pub. No.: WO2020/108944
PCT Pub. Date: Jun. 4, 2020

(65) Prior Publication Data

US 2021/0394941 A1 Dec. 23, 2021

(30) Foreign Application Priority Data

Nov. 26, 2018 (EP) ..... 18208330

(51) Int. Cl.
*B65B 31/04* (2006.01)
*B65B 31/02* (2006.01)
(Continued)

(52) U.S. Cl.
CPC ..... *B65B 31/045* (2013.01); *B65B 9/12* (2013.01); *B65B 31/02* (2013.01); *B65B 57/10* (2013.01)

(58) Field of Classification Search
CPC ..... B65B 31/045; B65B 9/12; B65B 31/02; B65B 57/10
See application file for complete search history.

(56) References Cited

U.S. PATENT DOCUMENTS 4,537,007 A 8/1985 Lattanzi
4,731,980 A 3/1988 Worden et al.
(Continued)

FOREIGN PATENT DOCUMENTS

CN 102089212 A 6/2011
CN 105452110 A 3/2016
(Continued)

OTHER PUBLICATIONS

U.S. Appl. No. 17/296,857, filed May 25, 2021, Daniele Anzaldi.
(Continued)

*Primary Examiner* — Andrew M Tecco
*Assistant Examiner* — Nicholas E Igbokwe
(74) *Attorney, Agent, or Firm* — BUCHANAN INGERSOLL & ROONEY PC

(57) ABSTRACT

A method for forming sealed partially-filled packages filled with a pourable product comprises at least forming a tube from a web of packaging material, filling the pourable product into the tube for forming a product column within the tube, directing a sterile gas into the product column for forming and/or maintaining a gas cushion within the product column, and forming and transversally sealing the tube, for obtaining the packages containing the pourable product and a gas space formed from a defined volume of the sterile gas originating from the gas cushion.

20 Claims, 2 Drawing Sheets

(51) Int. Cl.
*B65B 9/12* (2006.01)
*B65B 57/10* (2006.01)

(56) References Cited

U.S. PATENT DOCUMENTS

| | | | | |
|---|---|---|---|---|
| 4,747,253 | A * | 5/1988 | Schulte | B65B 31/006 53/511 |
| 4,819,414 | A * | 4/1989 | Worden | B29C 66/4312 53/550 |
| 4,964,259 | A * | 10/1990 | Ylvisaker | B65B 9/213 53/511 |
| 5,335,479 | A | 8/1994 | Lemke et al. | |
| 2006/0162290 | A1* | 7/2006 | Kakita | B65B 31/045 53/511 |
| 2009/0223173 | A1* | 9/2009 | Rapparini | B65B 55/106 53/469 |
| 2011/0185686 | A1 | 8/2011 | Konno et al. | |
| 2011/0192113 | A1 | 8/2011 | Kinoshita et al. | |
| 2012/0266571 | A1* | 10/2012 | Persson | B65B 31/045 53/473 |
| 2012/0297738 | A1 | 11/2012 | Krause et al. | |
| 2016/0107774 | A1* | 4/2016 | Kondo | B65B 39/005 53/512 |
| 2016/0122042 | A1 | 5/2016 | Breulmann | |
| 2019/0023432 | A1* | 1/2019 | Müller | G01M 3/229 |
| 2022/0024619 | A1 | 1/2022 | Anzaldi et al. | |

FOREIGN PATENT DOCUMENTS

| | | | |
|---|---|---|---|
| EP | 2343242 | A1 | 7/2011 |
| IN | 102131707 | A | 7/2011 |
| IN | 102713537 | A | 10/2012 |
| JP | S59-084706 | A | 5/1984 |
| JP | 2004-307005 | A | 11/2004 |
| JP | 2016-520490 | A | 7/2016 |
| WO | 2006021839 | A1 | 3/2006 |
| WO | 2014195112 | A1 | 12/2014 |
| WO | 2017/125386 | A2 | 7/2017 |

OTHER PUBLICATIONS

Office Action (The First Office Action) dated Jul. 25, 2022, by the State Intellectual Property Office of People's Republic of China in corresponding Chinese Patent Application No. 201980077526.0 and an English Translation of the Office Action. (17 pages).

International Search Report (PCT/ISA/210) with translation and Written Opinion (PCT/ISA/237) dated Feb. 21, 2020, by the European Patent Office as the International Searching Authority for International Application No. PCT/EP2019/080531.

Search Report for European Application No. 19 207 703.0 dated Mar. 29, 2021 (3 pages).

Office Action (Notice of Reasons for Refusal) dated Jul. 11, 2023, by the Japan Patent Office in corresponding Japanese Patent Application No. 2021-529372 and an English translation of the Office Action. (11 pages).

* cited by examiner

METHOD AND A PACKAGING APPARATUS FOR FORMING SEALED PARTIALLY-FILLED PACKAGES

TECHNICAL FIELD

The present invention relates to a method for forming sealed partially-filled packages filled with a pourable product, in particular a pourable food product, and comprising a gas space formed from a sterile gas.

The present invention relates to a packaging apparatus for forming sealed partially-filled packages filled with a pourable product, in particular a pourable food product, and comprising a gas space formed from a sterile gas.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging apparatuses, which advance a web of packaging material through a sterilization unit of the packaging apparatus for sterilizing the web of packaging material, e.g. by means of chemical sterilization (e.g. by applying a chemical sterilizing agent, such as a hydrogen peroxide solution) or physical sterilization (e.g. by means of an electron beam). Then, the sterilized web of packaging material is maintained and advanced within an isolation chamber (a closed and sterile environment), and is folded and sealed longitudinally to form a tube, which is further fed along a vertical advancing direction.

In order to complete the forming operations, the tube is continuously filled with a sterilized or sterile-processed pourable food product, and is transversally sealed and subsequently cut along equally spaced transversal cross sections within a package forming unit of the packaging apparatus during advancement along the vertical advancing direction.

Pillow packages are so obtained within the packaging apparatus, each pillow package having a longitudinal sealing band and a top transversal sealing band and a bottom transversal sealing band.

In some cases, there is the need to form partially-filled packages not only containing the pourable product, but also comprising a gas space being formed from a sterile gas. The respective gas spaces, once the packages have been produced and being placed in a distribution center such as a grocery store, arrange in the area of a respective upper portion of the packages. Thus, in the sector one defines these packages to comprise a headspace.

The reasons why to provide for a respective gas space within each package are various.

There are types of pourable products, which are composed of two or more components or phases, which separate during the storage of the filled packages. Thus, in order for the final consumer to enjoy the full flavor of the pourable product, it is necessary to mix the possibly separated components or phases by means of shaking of the filled packages. This is only possible if the package is only partially filled (i.e. there is a gas space within the package).

As well, there are types of pourable product for which it must be ensured that after their filling into the packages the organoleptic properties will not be subject to changes prior to their consumption. Typically, this means that contact with oxygen must be avoided. Therefore, it is needed to provide for a controlled gas space typically formed from a sterile inert gas such as nitrogen.

A packaging apparatus configured for the production of partially-filled packages is described in EP-A-0104698.

The packaging apparatus comprises a conveying device for advancing a web of packaging material along an advancement path, a sterilizing unit for sterilizing the web of packaging material, a tube forming and sealing device partially arranged within an isolation chamber and being adapted to form the tube from the advancing web of packaging material and to longitudinally seal the tube along a longitudinal seam portion of the tube, a filling pipe, in use, being coaxially arranged to and within the tube for continuously filling the tube with the pourable product and a package forming unit adapted to produce the single packages from the tube of packaging material by forming, transversally sealing and transversally cutting the packages.

The packaging apparatus also comprises a gas feeding device having a gas feeding pipe in fluid connection with the filling pipe and being configured to introduce a sterile gas into the pourable product flowing, in use, through the filling pipe. The sterile gas thus directed into the pourable product and is distributed within the pourable product. Thus, the pourable product containing the distributed sterile gas is filled into the tube. Once the packages have been formed, the sterile gas separates from the pourable product leading to the formation of the gas space within the packages.

Even though, the packaging apparatus disclosed in EP-A-0104698 operates in a satisfying and reliable manner, still some drawbacks have been observed with such a kind of packaging apparatus.

One drawback can be seen in the need to carefully control the gas feeding device in order to suppress the formation of foam during of the filling of the tube with the pourable product.

Another drawback can be seen in that there is a limit to the volume, which can be occupied by the sterile gas within a formed package, as otherwise it may become difficult to suppress the foaming of the pourable product during its filling.

A further drawback can be seen in that the precision of the volume of the sterile gas present within the filled packages is limited.

An even further drawback can be seen in the risk of clogging of the gas feeding pipe by the pourable product during a shutdown of the packaging apparatus.

A need is felt in the sector to further improve the packaging apparatuses. In particular, so as to overcome at least one of the above-mentioned drawbacks.

DISCLOSURE OF INVENTION

It is therefore an object of the present invention to provide in a straightforward and low-cost manner an improved packaging apparatus and an improved method for producing partially-filled packages.

According to the present invention, there is provided a method and a packaging apparatus according to the independent claims.

Further advantageous embodiments of the method and the packaging apparatus according to the invention are specified in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
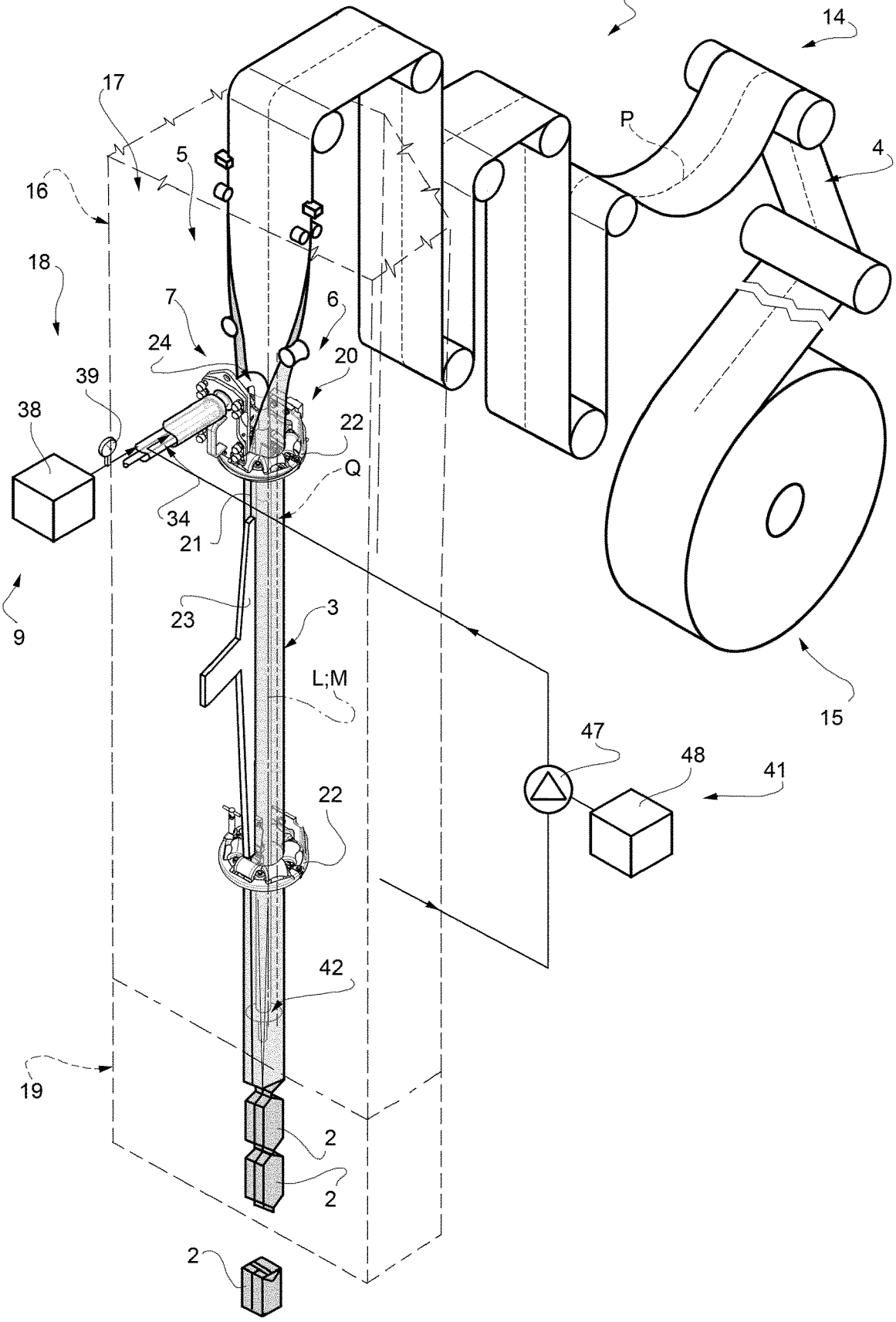
FIG. 1 is a schematic view of a packaging apparatus according to the present invention, with parts removed for clarity.

Number 1 indicates as a whole a packaging apparatus for producing sealed partially-filled packages 2 of a pourable food product, in particular a sterilized and/or sterile-processed pourable food product, such as pasteurized milk or fruit juice, from a tube 3 of a web 4 of packaging material. In particular, in use, tube 3 extends along a longitudinal axis L, in particular, axis L having a vertical orientation.

Web 4 of packaging material has a multilayer structure (not shown), and comprises at least a layer of fibrous material, such as e.g. a paper or cardboard layer, and at least two layers of heat-seal plastic material, e.g. polyethylene, interposing the layer of fibrous material in between one another. One of these two layers of heat-seal plastic material defines an inner face of package 2 eventually contacting the pourable product.

Preferably but not necessarily, web 4 also comprises a layer of gas- and light-barrier material, e.g. an aluminum foil or an ethylene vinyl alcohol (EVOH) film, in particular being arranged between one of the layers of the heat-seal plastic material and the layer of fibrous material. Preferentially but not necessarily, web 4 also comprises a further layer of heat-seal plastic material interposed between the layer of gas- and light-barrier material and the layer of fibrous material.

A typical package 2 obtained by packaging apparatus 1 comprises a sealed longitudinal seam portion and a pair of transversal seal portions, in particular a top transversal seal portion and a bottom transversal seal portion (i.e. one seal portion at an upper portion of package 2 and another seal portion at a lower portion of package 2).

With particular reference to FIG. 1, packaging apparatus 1 comprises at least:

a tube forming and sealing device 5 configured to form, in particular at a tube forming station 6, a tube 3 from web 4 and to longitudinally seal tube 3;

a filling device 7 configured to direct, in use, the pourable product, in particular at a constant flow rate, into tube 3 for obtaining a product column 8 within tube 3;

a gas feeding device 9 configured to direct, in particular during formation and filling (i.e. during operation of filling device 7 and tube forming and sealing device 5) of tube 3, a sterile gas into product column 8 such that a gas cushion 10 is formed and/or is maintained within product column 8; and a package forming unit 19 configured to form, to transversally seal and, preferably but not necessarily to transversally cut the, in use, advancing tube 3 for forming packages 2 containing the pourable product and a gas space formed from a defined volume of the sterile gas originating from gas cushion 10.

In particular, gas cushion 10 divides product column 8 into a first (an upper) portion 8*a* and a second (a lower) portion 8*b*.

Preferentially but not necessarily, package forming unit 19 is configured to transversally seal tube 3 through a portion of gas cushion 10 for obtaining gas space 11.

According to a preferred non-limiting embodiment, first portion 8*a* defines a seal of gas cushion 10 and/or of the sterile gas being within gas cushion 10.

In particular, the sterile gas can be sterile air or a sterile inert gas, such as sterile nitrogen. The specific sterile gas used can be chosen in dependence of e.g. the specific pourable product and/or the specific reason of why to provide for gas space 11, e.g. in the case that any contact of the pourable product packaged within packages 2 with oxygen should be avoided a sterile inert gas can be chosen. In the case that gas space 11 should allow for a later mixing of the pourable product packaged within packages 2, the sterile gas can be sterile air or any other sterile gas such as a sterile inert gas (e.g. sterile nitrogen).

In particular, by providing for gas feeding device 9 it is possible to precisely determine the volume of gas space 11 and to substantially suppress any possibility of foaming.

According to a preferred non-limiting embodiment, packaging apparatus 1 also comprises at least a conveying device 14 configured to advance (in a manner known as such) web 4 along a web advancement path P, in particular from a host station 15 to tube forming station 6, and to advance tube 3 and, in particular also any intermediates of tube 3, (in a manner known as such) along a tube advancement path Q.

In particular, with the wording intermediates of tube 3 any configuration of web 4 is meant prior to obtaining the tube structure and after folding of web 4 by tube forming and sealing device 5 has started. In other words, the intermediates of tube 3 are a result of the gradual folding of web 4 so as to obtain tube 3, in particular by overlapping with one another a first edge of web 4 and a second edge of web 4, opposite to the first edge.

According the preferred non-limiting embodiment disclosed, first portion 8*a* is positioned upstream of gas cushion 10 along path Q and second portion 8*b* is arranged downstream of gas cushion 10 along path Q.

According to a preferred non-limiting embodiment, packaging apparatus 1 also comprises an isolation chamber 16 having an inner environment 17, in particular being sterile, and being separated by isolation chamber 16 from an outer environment 18. In particular, inner environment 17 contains a sterile gas, in particular sterile air, which is preferentially but not necessarily pressurized so that the pressure within the inner environment 17 is higher than the ambient pressure.

Preferably but not necessarily, at least a portion of tube forming and sealing device 5 is arranged within isolation chamber 16 so as to form tube 3, in particular under sterile conditions, within isolation chamber 16 (i.e. tube forming station 6 is positioned within isolation chamber 16).

Preferably but not necessarily, conveying device 14 is configured to advance web 4 into and at least through a portion of isolation chamber 16.

Preferably but not necessarily, conveying device 14 is configured to advance tube 3 through at least a portion of isolation chamber 16 into and through at least a portion of package forming unit 19.

According to a preferred non-limiting embodiment, packaging apparatus 1 also comprises a sterilization unit (not shown and known as such) configured to sterilize the, in use, advancing web 4 by means of physical sterilization (such as e.g. electromagnetic irradiation, electron beam irradiation, gamma ray irradiation, beta ray irradiation, UV light) or chemical sterilization (e.g. by means of a hydrogen peroxide bath, vaporized hydrogen peroxide) at a sterilization station. In particular, the sterilization station is arranged upstream of tube forming station 6 along path P. In other words, sterilization unit is configured to sterilize web 4 prior to web 4, in use, entering into isolation chamber 16.

Preferentially but not necessarily, tube forming and sealing device 5 comprises a tube forming unit 20 at least partially, preferably fully, arranged within isolation chamber 16, in particular at tube forming station 6, and being adapted to (configured to) gradually fold the, in use, advancing web 4 into tube 3, in particular by overlapping the first edge and the second edge with one another, for forming a longitudinal seal seam portion 21 of tube 3.

Preferably but not necessarily, tube forming unit 20 extends along a longitudinal axis M, in particular having a vertical orientation.

In particular, seam portion 21 extends from an initial level (not specifically shown) into a downward direction along path Q. In other words, the initial level is at the position at which the first edge and the second edge start to overlap one another for forming seam portion 21.

In particular, at least a portion of path Q lies within isolation chamber 16 (in particular, within inner environment 17).

In more detail, axis L and axis M are parallel to one another. In even more detail, tube forming unit 20 defines, in use, axis L of tube 3.

Preferentially but not necessarily, tube forming unit 20 comprises at least two forming ring assemblies 22, in particular arranged within isolation chamber 16 (in particular, within inner environment 17), being adapted to gradually fold in cooperation with one another web 4 into tube 3.

In the specific case shown, one forming ring assembly 22 is arranged downstream of the other forming ring assembly 22 along path Q.

In particular, each one of forming ring assemblies 22 substantially lies within a respective plane, in particular each plane being orthogonal to axis M, even more particular each respective plane having a substantially horizontal orientation.

Even more particular, forming ring assemblies 22 are spaced apart from, and parallel to, one another (i.e. the respective planes are parallel to, and spaced apart from, one another).

Preferentially but not necessarily, each plane is orthogonal to axis M and to axis L.

Furthermore, forming ring assemblies 22 are arranged coaxial to one another and define longitudinal axis M of tube forming unit 20.

According to a preferred non-limiting embodiment, tube forming and sealing device 5 also comprises a sealing unit adapted to (configured to) longitudinally seal tube 3 along seam portion 21. In other words, in use, seam portion 21 formed by tube forming unit 20 becomes sealed by activation of the sealing unit.

Preferentially but not necessarily, the sealing unit is at least partially positioned within isolation chamber 16.

It must be noted that the respective longitudinal sealed seam portions of the single packages 2 result from cutting tube 3. In other words, the respective seam portions of the single packages 2 are respective sections of seam portion 21 of tube 3.

Furthermore, the sealing unit comprises a sealing head 23 arranged within isolation chamber 16 and being adapted to (configured to) transfer thermal energy on tube 3, in particular on seam portion 21 for longitudinally sealing seam portion 21. Sealing head 23 can be of any type. In particular, sealing head 23 can be of the kind operating by means of induction heating and/or by a stream of a heated gas and/or by means of ultrasound and/or by laser heating and/or by any other means.

In more detail, sealing head 23 is arranged substantially between forming ring assemblies 22.

Preferentially but not necessarily, the sealing unit also comprises a pressing assembly (only partially shown) adapted to exert a mechanical force on tube 3 onto seam portion 21, so as to ensure the longitudinal sealing of tube 3 along seam portion 21.

In particular, the pressing assembly comprises at least an interaction roller and a counter-interaction roller (not shown) adapted to exert the mechanical force onto seam portion 21 from opposite sides thereof. In particular, in use, seam portion 21 is interposed between the interaction roller and the counter-interaction roller.

Preferentially but not necessarily, the interaction roller is supported by the forming ring assembly 22 being downstream of the other forming ring assembly 22.

Figure 2:
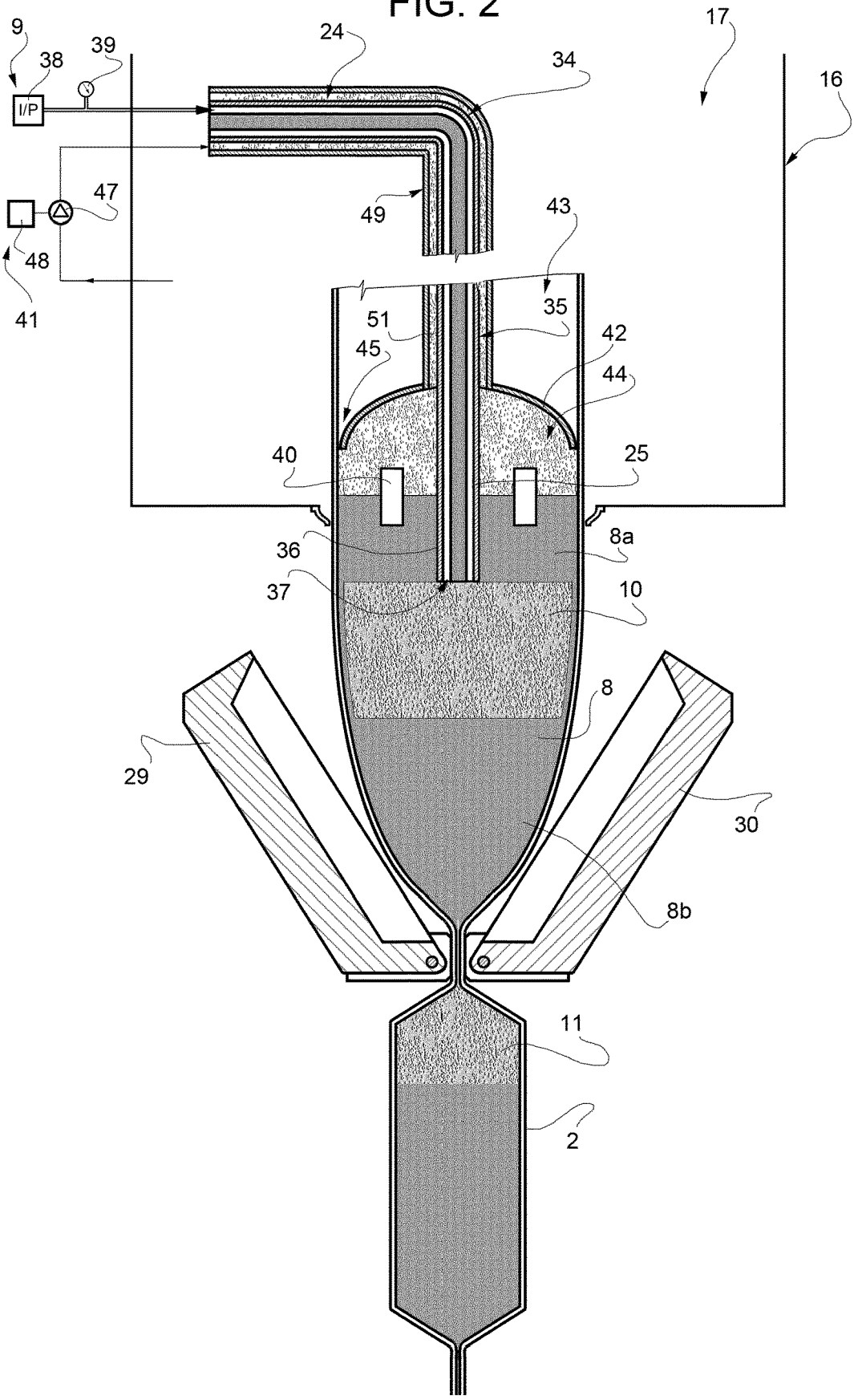
FIG. 2 is an enlarged view of a detail of the packaging apparatus of FIG. 1, with parts removed for clarity.

With particular reference to FIGS. 1 and 2, filling device 7 comprises a filling pipe 24 being in fluid connection with a pourable product storage tank (not shown and known as such), which is adapted to store/provide the pourable product, in particular the sterilized and/or sterile-processed pourable food product, to be packaged.

In particular, filling pipe 24 is adapted to (configured to) direct, in use, the pourable product into tube 3 for obtaining product column 8.

Preferentially but not necessarily, filling pipe 24 is, in use, at least partially placed within tube 3 for continuously feeding the pourable product into tube 3.

In particular, filling pipe 24 comprises a main pipe portion 25 extending, in use, within and parallel to tube 3, i.e. parallel to axis M and axis L.

Preferentially but not necessarily, at least a portion of main pipe portion 25 comprises one or more outlets (not shown) configured to allow for the outflow of the pourable product out of main pipe portion 25 and into tube 3. Preferably but not necessarily, the one or more outlets are laterally arranged.

According to a preferred non-limiting embodiment as shown in FIG. 2, package forming unit 19 comprises a plurality of pairs of at least one respective operative assembly 29 (only one shown) and at least one counter-operative assembly 30 (only one shown); and in particular, a conveying device (not shown and known as such) adapted to advance the respective operative assemblies 29 and the respective counter-operative assemblies 30 of the pairs along respective conveying paths.

In more detail, each operative assembly 29 is adapted to cooperate, in use, with the respective counter-operative assembly 30 of the respective pair for forming a respective package 2 from tube 3. In particular, each operative assembly 29 and the respective counter-operative assembly 30 are configured to form, to transversally seal and, preferably but not necessarily also to transversally cut, tube 3 for forming packages 2. Even more particular, each operative assembly 29 and the respective counter-operative assembly 30 are configured to transversally seal tube 3 through a portion of gas cushion 10 for obtaining gas space 11.

In further detail, each operative assembly 29 and the respective counter-operative assembly 30 are adapted to cooperate with one another for forming a respective package 2 from tube 3 when advancing along a respective operative portion of the respective conveying path.

In even more detail, each operative assembly 29 and the respective counter-operative assembly 30 are configured to contact tube 3 when advancing along the respective operative portion of the respective conveying path, in particular starting to contact tube 3 at a (fixed) hit position.

With particular reference to FIG. 2, gas feeding device 9 is configured to direct, in particular continuously direct, the sterile gas into product column 8 and, preferentially but not necessarily, to control the gas pressure of the sterile gas within gas cushion 10.

Preferentially but not necessarily, gas feeding device 9 is configured to control the gas pressure of the sterile gas of gas cushion 10 to range between 5 kPa to 40 kPa, in particular between 10 kPa to 30 kPa, above ambient pressure.

Preferentially but not necessarily, gas feeding device 9 comprises a gas feeding tube 34 configured to direct, in use, the sterile gas into product column 8 for forming and/or maintaining gas cushion 10. In particular, gas feeding tube 34 is configured to feed, in use, the sterile gas for forming and/or for maintaining gas cushion 10.

More specifically, gas feeding tube 34 comprises a first portion 35 at least partially extending, in use, within tube 3 and being configured to allow an outflow of the sterile gas from first portion 35 into product column 8 for forming and/or maintaining gas cushion 10.

Even more specifically, gas feeding tube 34, in particular first portion 35, comprises an end section 36 configured to extend, in use, through a portion of product column 8, in particular first portion 8*a*, and having at least one outlet 37 for allowing the sterile gas to exit from gas feeding tube 34 and into product column 8 so as to control the formation and maintenance of gas cushion 10.

According to a preferred non-limiting embodiment, outlet 37 is delimited by gas feeding tube 34 and filing pipe 24. In particular, outlet 37 has an annular shape.

Preferentially but not necessarily, gas feeding device comprises a pressure and flow control assembly 38 configured to control the pressure and/or the flow rate of the sterile gas and being fluidically connected to gas feeding tube 34. Preferentially but not necessarily, pressure and flow control assembly 38 comprises a(n) (electronic) pressure regulator and/or a(n) (electronic) flow regulator for controlling respectively the pressure and the flow rate of the sterile gas.

According to a preferred non-limiting embodiment, gas feeding device 9, in particular pressure and flow control assembly 38, is configured to control the pressure and/or flow of the sterile gas as a function of the type and/or format of packages 2.

According to a preferred non-limiting embodiment, gas feeding device 9, in particular pressure and flow control assembly 38, is configured to control the pressure and/or flow of the sterile gas so as to control the volume of gas space 11 within packages 2.

In this context it can be noted, that the volume of gas space 11 within package 2 and the volume of the pourable product within package 2 is a function of the flow rate of the pourable product and/or of the pressure of the sterile gas and/or of the flow rate of the sterile gas.

According to a preferred non-limiting embodiment, during operation of packaging apparatus 1 the flow rate of the pourable product is kept constant so that the volume of gas space 11 and the volume of the pourable product is controlled by gas feeding device 9, in particular pressure and flow control assembly 38.

According to an alternative preferred non-limiting embodiment, the flow rate of the pourable product could be controlled.

Preferably but not necessarily, gas feeding device 9, in particular pressure and flow control assembly 38, is configured such that the volume of gas space 11 within packages 2 ranges between 1% to 35%, in particular 5% to 20%, of an overall inner volume of packages 2.

Even more preferentially but not necessarily, gas feeding device 9 also comprises a sterile gas source (not shown) configured to provide for the sterile gas, such as sterile air, sterile inert gas, sterile nitrogen. In particular, the sterile gas source is in fluid connection with pressure and flow control assembly 38.

According to a preferred non-limiting embodiment, gas feeding device 9 also comprises a pressure sensor 39 configured to determine and/or detect the pressure of the sterile gas. In particular, pressure sensor 39 is arranged within gas feeding tube 34.

According to a preferred non-limiting embodiment, packaging apparatus 1, in particular gas feeding device 9, comprises at least one level detection unit configured to determine and/or detect the elevation level of product column 8 within tube 3. Preferentially but not necessarily, the level detection unit is configured to determine the (elevation) level of an upstream interface of product column 8, in particular of first portion 8*a*, from which, in use, product column 8 extends downstream along path Q.

In particular, in use, product column 8 extends from the upstream interface of product column 8 to the transversal seal portion of the respective package 2 to be formed.

According to a preferred non-limiting embodiment, the level detection unit is configured to determine the elevation level in relative measures with respect to a base elevation level.

In more detail, the level detection unit comprises a product floater 40 configured to float on product column 8, in particular first portion 8*a*, even more particular in the area of the upstream interface, and a sensor (not shown) being, in use, arranged outside of tube 3, and being configured to detect and/or determine (in a non-contact manner) a height position of product floater 40 indicative of the elevation level of product column 8.

In even more detail, product floater 40 comprises a magnetic or ferromagnetic element and the sensor is configured to determine and/or detect the height position by means of electromagnetic interactions.

According to a preferred non-limiting embodiment, gas feeding device 9, in particular pressure and flow control assembly 38, is configured to control the pressure of the sterile gas as a function of the elevation level, in particular such that the elevation level of the product column 8 remains, in use, substantially constant.

In particular, in this way, it is possible to guarantee that the relative volume of pourable product and the relative volume of gas space 11 contained within packages 2 is substantially the same for all packages 2 at a constant flow rate It should be noted that in this context substantially constant means that the elevation level remains the same with the difference of fluctuations inherent of the filling of pourable product. Considering these fluctuations, it should be noted that the elevation level fluctuates at about 10 mm to 50 mm, in particular 25 mm to 35 mm, even more particular 30 mm, from an average elevation level.

According to a preferred non-limiting embodiment, packaging apparatus 1 also comprises a pressurizing device configured to control an auxiliary pressure of an auxiliary sterile gas, in particular sterile air, acting on product column 8, in particular directly acting on first portion 8*a*. More specifically, first portion 8*a* is interposed between the auxiliary sterile gas and gas cushion 10.

Preferentially but not necessarily, pressurizing device 41 is configured to control the pressure of the auxiliary sterile gas acting on product column 8 to range between 5 kPa to 40 kPa, in particular between 10 kPa to 30 kPa, above ambient pressure.

More specifically, pressurizing device 41 is configured such that the auxiliary sterile gas acts on product column 8 in the area of the upstream interface of product column 8, in particular first portion 8*a*. In other words, a portion of product column 8 is interposed between the auxiliary sterile gas and gas cushion 10.

According to the preferred non-limiting embodiment disclosed, packaging apparatus 1 also comprises a delimiting element 42 placed, in use, within tube 3 and, preferentially but not necessarily within isolation chamber 16.

In particular, delimiting element 42 is designed to divide tube 3, in use, into a first space 43 and a second space 44, second space 44 containing, in use, product column together with gas cushion 10 formed and/or maintained within product column 8.

In particular, first portion 8*a* is interposed between delimiting element 42 and gas cushion 10.

In more detail, first space 43 is delimited by tube 3, in particular the walls of tube 3, and delimiting element 42. Furthermore, first space 43 opens into inner environment (and the sterile gas present within first space 43 substantially has the same pressure as the sterile gas present in inner environment 17). Even more particular, delimiting element 42 delimits first space 43 in the area of a downstream portion (with respect to path Q) of first space 43.

In more detail, second space 44 is delimited, in use, by tube 3, in particular the walls of tube 3, delimiting element 42 and the transversal seal portion of one respective package 2 (to be formed).

In other words, second space 44 extends in a direction parallel to path Q (i.e. parallel to axis L) from delimiting element 42 to the seal portion.

In even other words, delimiting element 42 delimits second space 44 in the area of an upstream portion (with respect to path Q) of second space 44, in particular an upper portion, of second space 44 itself; and the seal portion delimits second space 44 in the area of a downstream portion (with respect to path Q), in particular a bottom portion, of second space 44.

In further detail, first space 43 is arranged upstream of second space 44 along tube advancement path Q. Even more particular, first space 43 is arranged upstream of delimiting element 42 along path Q and second space 44 is arranged downstream of delimiting element 42 along path Q.

In the specific example shown, second space 44 is placed below first space 43.

According to the preferred non-limiting embodiment disclosed, pressurizing device 41 is adapted to (configured to) direct, in particular to continuously direct, in use, a flow of the auxiliary sterile gas into a zone of second space 44 between delimiting element 42 and product column 8 so that the auxiliary sterile gas acts, in use, on product column 8.

Preferably but not necessarily, first space 43 is in (direct) fluidic connection with inner environment 17. Thus, sterile gas present in the first space 43 can flow to inner environment 17.

More specifically, delimiting element 42 is arranged, in use, downstream of the above-mentioned initial level along path Q.

Furthermore, in use, filling device 7, in particular filling pipe 24, is adapted to (configured to) direct the pourable product into second space 44. In other words, product column 8 is positioned within second space 44.

Preferably but not necessarily, delimiting element 42 is designed to provide, in use, for at least one fluidic channel 45, in particular having an annular shape, for fluidically connecting second space 44 with first space 43 allowing for, in use, a leakage flow of the auxiliary sterile gas from second space 44 into first space 43.

According to a preferred non-limiting embodiment, delimiting element 42 is designed such that tube 3 and delimiting element 42 do not contact one another. In other words, the radial extension of delimiting element 42 is smaller than the inner radial extension of tube 3.

Preferentially but not necessarily, pressurizing device comprises a closed sterile gas circuit from inner environment 17 into second space 44 and back into inner environment 17. This allows a simplified overall construction of packaging apparatus 1, in particular related to the control and the supply of the auxiliary sterile gas.

According to the preferred non-limiting embodiment disclosed, pressurizing device 41 is configured to withdraw sterile gas from inner environment 17, to pressurize (to compress) the auxiliary sterile gas and to direct the pressurized (compressed) auxiliary sterile gas into second space 44.

Preferentially but not necessarily, pressurizing device 41 comprises at least:

one pumping device 47 configured to withdraw sterile gas from inner environment 17, to pressurize (to compress) the sterile gas and to direct the pressurized sterile gas as the auxiliary sterile gas into second space 44; and one control unit 48 configured to control operation of pumping device 47.

Preferably but not necessarily, pressurizing device 41 comprises a gas feeding pipe 49 being at least fluidically connected with second space 44 for directing the auxiliary sterile gas into second space 44.

In more detail, at least a portion of gas feeding pipe 49 extends, in use, within tube 3 and in particular parallel, even more particular coaxial, to main pipe portion 25 and/or first portion 35.

In the specific example shown, filling pipe 24 extends at least partially within gas feeding pipe 49. Alternatively, gas feeding pipe 49 could at least partially extend within filling pipe 24.

Preferentially but not necessarily, gas feeding pipe 49 and gas feeding tube 34, in particular first portion 35, define/delimit an annular conduit 51 for the auxiliary sterile gas to be fed into second space 44. In particular, annular conduit 51 is delimited by a portion of the inner surface of gas feeding pipe 49 and a portion of the outer surface of gas feeding tube 34.

Preferentially but not necessarily, delimiting element is removably connected, in particular in a floating manner, to at least a portion of filling pipe 24 and/or gas feeding pipe 49 and/or gas feeding tube 34. In particular, in a floating manner means that delimiting element 42 is adapted to (slightly) move parallel to at least axis M (and to axis L). In other words, delimiting element 42 is adapted to (slightly) move parallel to the, in use, advancing tube 3.

In use, packaging apparatus 1 forms packages 2 filled with a pourable product. In particular, packaging apparatus 1 forms packages 2 from tube 3 formed from web 4, tube 3 being continuously filled with the pourable product.

In more detail, operation of packaging apparatus 1 comprises at least the steps of:

forming tube 3 from web 4;

longitudinally sealing tube 3, in particular along seam portion 21;

filling the pourable product into tube 3 for forming product column 8 within tube 3;

directing, in particular during the step of forming, the step of longitudinally sealing and the step of filling, the sterile gas into product column 8 for forming and/or maintaining gas cushion 10 within product column 8; and forming package 2 by forming and transversally sealing tube 3 for obtaining packages 2 containing the pourable product and gas space 11 formed from a defined volume of the sterile gas originating from gas cushion 10.

Preferentially but not necessarily, package forming unit 19 is configured to transversally seal tube 3 through a portion of gas cushion 10 for obtaining gas space 11.

Preferentially but not necessarily, operation of packaging apparatus 1 also comprises at least the steps of:

advancing web 4 along path P, in particular from host station 15, to tube forming station 6; and advancing tube 3 along path Q.

According to a preferred non-limiting embodiment, operation of packaging machine 1 also comprises the step of sterilizing web 4, in particular by means of physical and/or chemical sterilization.

According to a preferred non-limiting embodiment, during the step of forming package 2, package 2 is transversally sealed through a portion of gas cushion 10 for obtaining gas space 11.

According to a preferred non-limiting embodiment, during the step of forming package 2, tube 3 is also transversally cut in the area of the transversal seal obtained during the transversal sealing so as to obtain packages 2 being separated from one another.

In more detail, during the step of directing the sterile gas, gas feeding device 9, in particular pressure and flow control assembly 38, directs the sterile gas into product column 8 for forming and/or maintaining gas cushion 10 and controls the pressure of the sterile gas within gas cushion 10 such that the pressure ranges between 5 kPa to 40 kPa, in particular between 10 kPa to 30 kPa, above ambient pressure.

In even more detail, during the step of directing the sterile gas, the sterile gas is directed through gas feeding tube 34 into gas cushion 10.

Preferentially but not necessarily, the sterile gas pressure and/or flow is controlled by pressure and flow control assembly 38.

In particular, pressure and flow control assembly 38 provides and pressurizes the sterile gas and directs the sterile gas into product column 8 for forming and/or maintaining gas cushion 10.

According to a preferred non-limiting embodiment, the pressure and/or flow of the sterile gas is controlled, in particular by gas feeding device 9, even more particular by pressure and flow control assembly 38, as a function of a size and/or a format of the packages 2. Preferentially but not necessarily, the flow rate of the pourable product is kept constant.

According to an alternative preferred non-limiting embodiment, the flow rate of the pourable product is controlled as a function of a size and/or a format of the packages 2. Preferentially but not necessarily, the pressure and/or flow of the sterile gas is kept constant.

Even more particularly, the sterile gas flows from pressure and flow control assembly 38 through gas feeding tube 34 and out of outlet 37 into product column 8 for forming and/or maintaining gas cushion 10.

According to a preferred non-limiting embodiment, operation of packaging apparatus 1 also comprises the step of determining and/or detecting the elevation level of product column 8 within tube 3, in particular by means of the level detection unit.

Preferentially but not necessarily, during the step of determining and/or detecting the elevation level of product column 8, the height position of product floater 40, indicative of the level of product column 8, is determined and/or detected by the sensor of the level detection unit, in particular by means of electromagnetic interactions.

According to a preferred but non-limiting embodiment, during operation of packaging apparatus 1 the pressure of the sterile gas is controlled, in particular by gas feeding device 9, even more particular by pressure and flow control assembly 38, as a function of the elevation level, in particular so that the elevation level of product column 8 remains substantially constant. Preferentially but not necessarily, the flow rate of the pourable product is kept constant.

According to an alternative preferred non-limiting embodiment, during operation of packaging apparatus 1 the flow rate of the pourable product is controlled as a function of the elevation level, in particular so that the elevation level of product column 8 remains substantially constant. Preferentially but not necessarily, the pressure of the sterile gas is kept substantially constant.

According to a preferred but non-limiting embodiment, operation of packaging apparatus 1 also comprises a step of controlling the pressure of the auxiliary sterile gas acting on product column 8 during which the auxiliary sterile gas acts on product column 8.

In particular, during the step of controlling the pressure of the auxiliary sterile gas, the pressure of the auxiliary sterile gas is controlled such that the pressure ranges between 5 kPa to 40 kPa, in particular between 10 kPa to 30 kPa, above ambient pressure.

In particular, pressurizing device 41 controls the pressure of the auxiliary sterile gas acting on product column 8.

According to a preferred non-limiting embodiment, during the step of controlling the pressure of the auxiliary sterile gas, the auxiliary sterile gas is directed into a zone of second space 43 between delimiting element 42 and product column 8 so as to exert a pressure on product column 8.

According to a preferred non-limiting embodiment, during the step of controlling the pressure of the auxiliary sterile gas, the sterile gas is withdrawn from isolation chamber 16, in particular from inner environment 17, becomes pressurized (compressed) and then directed, in particular continuously directed, into second space 44.

More specifically, pressurizing device 41 extracts the sterile gas present within isolation chamber 16, in particular from inner environment 17, pressurizes (compresses) the sterile gas and directs it as the auxiliary sterile gas into the zone between delimiting element 42 and product column 8. In particular, a portion of the auxiliary sterile gas flows from second space 44 through fluidic channel 45 into first space 43.

In further detail, during the step of forming tube 3, web 4 is formed into tube 3 within isolation chamber 16.

In particular, during the step of forming tube 3, web 4 is formed into tube 3 and is longitudinally sealed along seam portion 21.

In further detail, the step of forming comprises the sub-step of gradually overlapping the first lateral edge and the second lateral edge of web 4 with one another for forming seam portion 21.

In even further detail, during the sub-step of gradually overlapping, the first lateral edge and the second lateral edge become overlapped by advancement of web 4 along path P and the action of forming ring assemblies 22.

In further detail, during the step of longitudinally sealing tube 3, tube 3 is longitudinally sealed within isolation chamber 16.

In even further detail, during the step of longitudinally sealing tube 3, sealing head 23 applies heat on seam portion 21 and, preferentially but not necessarily, the pressing assembly exerts a mechanical force onto seam portion 21.

The filling step comprises the sub-step of directing the pourable product through filling pipe 24 into second space 44. In particular, the pourable product exits from main pipe portion 25 into second space 44.

During the package forming step, packages 2 are formed by operation of package forming unit 19, which receives tube after the step of forming. In particular, during the package forming step operative assemblies 29 and counter-operative assemblies 30 advance along their respective conveying paths. When operative assemblies 31 and their respective counter-operative assemblies 32 advance along their respective operative portions, operative assemblies 31 and the respective counter-operative assemblies 32 cooperate with one another for forming, transversally sealing and, preferably but not necessarily, transversally cutting the advancing tube 3 so as to form packages 2. During the package forming step, the pourable product is continuously directed into second space 44 so as to obtain filled packages 2.

The advantages of packaging apparatus 1 according to the present invention will be clear from the foregoing description.

In particular, packaging apparatus 1 and the method allow for the production of partially-filled packages 2 with a determination of the volume of gas space 11 at high precision.

Another advantage is that the formation of foam during the filling of tube 3 is substantially impeded by providing for gas cushion 10.

A further advantage resides in that there is hardly any risk of clogging of gas feeding pipe 34.

An even further advantage is that the volume of gas space 11 can be larger than the one as obtainable with known methods and packaging apparatuses.

It is a further advantage that first portion 8*a* of product column 8 acts as a seal for the sterile gas within cushion 10 allowing a reduced sterile gas loss and a reduced overall sterile gas consumption.

Clearly, changes may be made to packaging apparatus 1 as described herein without, however, departing from the scope of protection as defined in the accompanying claims.

In an alternative embodiment not shown, pressurizing device 41 is configured to pressurize at least a portion of isolation chamber 16 so that the auxiliary sterile gas defined by the sterile gas present within isolation chamber acts on product column 8. In such an alternative embodiment, packaging apparatus 1 would not comprise delimiting element 42.

In a further alternative embodiment not shown, filling pipe 24 and gas feeding tube 34 and/or gas feeding pipe 49 could be arranged spaced apart from one another.

In an even other alternative embodiment not shown, delimiting element 42 could be designed to abut, in use, against the inner surface of tube.

The invention claimed is:

1. A method for forming sealed partially-filled packages filled with a pourable product comprising at least:

forming a tube from a web of packaging material;

filling the pourable product into the tube for forming a product column within the tube;

directing a sterile gas into the product column for forming and/or maintaining a gas cushion within the product column which divides the product column into an upper portion and a lower portion;

forming and transversally sealing the tube, for obtaining the packages containing the pourable product and a gas space formed from a defined volume of the sterile gas originating from the gas cushion.

2. The method according to claim 1, further comprising:

detecting and/or determining an elevation level of the product column;

controlling pressure of the sterile gas as a function of the elevation level.

3. The method according to claim 2, wherein during the controlling of the pressure of the sterile gas, the pressure of the sterile gas is controlled such that the elevation level of the product column remains substantially constant.

4. The method according to claim 2, wherein during the controlling of the pressure of the sterile gas, the pressure and/or flow of the sterile gas is controlled as a function of a size and/or a format of the packages.

5. The method according to claim 1, wherein the forming and transversally sealing of the tube comprises transversally sealing the tube through a portion of the gas cushion for obtaining the gas space in the packages.

6. The method according to claim 1, wherein during the directing of the sterile gas, pressure and/or flow of the sterile gas is controlled such that the volume of sterile gas present within the packages ranges between 1% to 35% of an overall inner volume of the packages.

7. The method according to claim 1, wherein during the directing of the sterile gas into the product column, pressure of the sterile gas within the gas cushion is controlled between 5 kPa to 40 kPa above ambient pressure.

8. The method according to claim 1, and further comprising at least controlling a pressure of an auxiliary sterile gas acting on the product column.

9. The method according to claim 8, wherein, in use, a delimiting element is arranged within the tube and divides the tube into a first space and a second space;

wherein the second space contains the product column and during the controlling of the pressure of the auxiliary sterile gas, the auxiliary sterile gas is directed into a zone of the second space between the delimiting element and the product column.

10. The method according to claim 1, and further comprising at least:

advancing the web of packaging material to a tube forming station at which the web of packaging material is formed into the tube; and advancing the tube along a tube advancement path.

11. The method according to claim 1, wherein during the directing of the sterile gas into the product column, the pressure of the sterile gas within the gas cushion is controlled between 10 kPa to 30 kPa above ambient pressure.

12. A packaging apparatus for forming sealed partially-filled packages filled with a pourable product comprising at least:

a tube forming and sealing device configured to form a tube from a web of packaging material and to longitudinally seal the tube;

a filling device adapted to direct, in use, a pourable product into the tube for obtaining a product column within the tube;

a gas feeding device configured to direct a sterile gas into the product column such that, in use, a gas cushion which divides the product column into an upper portion and a lower portion is formed and/or maintained within the product column;

a package forming unit for forming and transversally sealing the tube for obtaining the packages filled with the pourable product and containing a gas space containing a defined volume of the sterile gas present within the gas cushion.

13. The packaging apparatus according to claim 12, wherein the gas feeding device comprises a level detection unit configured to detect and/or determine an elevation level of the product column; and wherein the gas feeding device is configured to control pressure of the sterile gas as a function of the elevation level.

14. The packaging apparatus according to claim 12, wherein the gas feeding device is configured to control pressure of the sterile gas such that the elevation level of the product column remains, in use, substantially constant.

15. The packaging apparatus according to claim 12, wherein the package forming unit is so configured as to transversally seal the tube through a portion of the gas cushion for obtaining the gas space in the packages.

16. The packaging apparatus according to claim 12, wherein the gas feeding device is configured to control pressure of the sterile gas as a function of a size and/or a format of the packages.

17. The packaging apparatus according to claim 12, wherein the gas feeding device is configured to control a gas pressure of the sterile gas of the gas cushion to range between 5 kPa to 40 kPa above ambient pressure.

18. The packaging apparatus according to claim 12, and further comprising at least a pressurizing device configured to control an auxiliary pressure of an auxiliary sterile gas acting on the product column.

19. The packaging apparatus according to claim 18, and further comprising a delimiting element, in use, arranged within the tube for dividing the tube into a first space and a second space;

wherein the second space comprises the product column; and wherein the pressurizing device (41) is configured to direct the auxiliary sterile gas into a zone of the second space between the delimiting element and the product column.

20. The packaging apparatus according to claim 12, wherein the gas feeding device is configured to control a gas pressure of the sterile gas of the gas cushion to range between 10 kPa to 30 kPa above ambient pressure.

* * * * *